US011365521B2

(12) United States Patent
Jones

(10) Patent No.: US 11,365,521 B2
(45) Date of Patent: Jun. 21, 2022

(54) PAVEMENT JOINT CLEANING SYSTEM

(71) Applicant: Pave Tech, Inc., Prior Lake, MN (US)

(72) Inventor: Stephen Jones, Prior Lake, MN (US)

(73) Assignees: Stephen Jones, Prior Lake, MN (US); Pamela Jones, Prior Lake, MN (US)

( * ) Notice: Subject to any disclaimer, the term of this patent is extended or adjusted under 35 U.S.C. 154(b) by 0 days.

(21) Appl. No.: 16/196,865

(22) Filed: Nov. 20, 2018

(65) Prior Publication Data

US 2019/0085520 A1 Mar. 21, 2019

Related U.S. Application Data

(63) Continuation-in-part of application No. 15/170,539, filed on Jun. 1, 2016.

(Continued)

(51) Int. Cl.

| | |
|---|---|
| ***E01H 1/08*** | (2006.01) |
| ***A47L 5/14*** | (2006.01) |
| ***A47L 9/00*** | (2006.01) |
| ***A47L 9/08*** | (2006.01) |
| ***A47L 9/24*** | (2006.01) |

(Continued)

(52) U.S. Cl.

CPC ..... *E01H 1/0863* (2013.01); *A47L 5/14* (2013.01); *A47L 9/009* (2013.01); *A47L 9/08* (2013.01); *A47L 9/24* (2013.01); *B08B 3/024* (2013.01); *B08B 5/02* (2013.01); *B08B 5/04* (2013.01); *B08B 15/02* (2013.01)

(58) Field of Classification Search

CPC .. B08B 5/02; B08B 5/04; B08B 15/02; B08B 3/024; A47L 9/08; A47L 9/24; A47L 5/14; A47L 9/009; E01H 1/0863

See application file for complete search history.

(56) References Cited

U.S. PATENT DOCUMENTS 2,224,202 A * 12/1940 Smellie ..... A47L 9/1683 15/346
2,971,210 A * 2/1961 Thompson ..... A47L 9/08 15/346

(Continued)

FOREIGN PATENT DOCUMENTS

CN 102797236 A 11/2012
DE 3703865 * 8/1988

(Continued)

OTHER PUBLICATIONS

English machine translation of EP2372025A1.*

(Continued)

*Primary Examiner* — Benjamin L Osterhout
(74) *Attorney, Agent, or Firm* — Westman, Champlin & Koehler, P.A.; Z. Peter Sawicki; Amanda M. Prose

(57) ABSTRACT

A cleaning system for pavement joints controlled and driven by a motor. A wheeled housing carries a nozzle system where a stream of pressurized or forced air is directed through rotating nozzles to clean the joint surfaces. The rotational speed (RPM) of the motor is selectively controlled by actuation of a valve by the operator, and allows the operator to selectively control the rate of rotation of the nozzles are required by the state of the surface to be cleaned. A suction head is further movable over the joint surfaces to remove the debris dislodged by the nozzle system and airflow.

11 Claims, 5 Drawing Sheets

Related U.S. Application Data

(60) Provisional application No. 62/171,123, filed on Jun. 4, 2015.

(51) Int. Cl.

| | |
|---|---|
| ***B08B 3/02*** | (2006.01) |
| ***B08B 5/02*** | (2006.01) |
| ***B08B 5/04*** | (2006.01) |
| ***B08B 15/02*** | (2006.01) |

(56) References Cited

U.S. PATENT DOCUMENTS

| | | | | | |
|---|---|---|---|---|---|
| 3,004,279 | A | * | 10/1961 | Ringer | E01H 1/0872 15/346 |
| 3,432,969 | A | | 3/1969 | Byttebier | |
| 3,869,749 | A | * | 3/1975 | London | B08B 3/024 15/302 |
| 3,916,568 | A | | 11/1975 | Rose et al. | |
| 3,959,846 | A | * | 6/1976 | Yasuda | A47L 7/00 15/331 |
| 4,037,290 | A | | 7/1977 | Rose et al. | |
| 4,107,816 | A | | 8/1978 | Matthews | |
| 4,377,018 | A | | 3/1983 | Cain | |
| 4,443,271 | A | | 4/1984 | Goerss | |
| 5,312,044 | A | | 5/1994 | Eaton | |
| 5,464,114 | A | * | 11/1995 | Green | F16L 55/1157 137/377 |
| D375,591 | S | * | 11/1996 | Fryoux | D32/15 |
| 6,378,163 | B1 | | 4/2002 | Moll et al. | |
| 2012/0151708 | A1 | | 6/2012 | Carter et al. | |
| 2013/0118529 | A1 | * | 5/2013 | Gromes, Sr. | A47L 11/4044 134/21 |

FOREIGN PATENT DOCUMENTS

| | | | | | |
|---|---|---|---|---|---|
| DE | 9308463 | U1 | * | 8/1993 | B08B 5/02 |
| DE | 9308463 | U1 | | 8/1993 | |
| DE | 19539586 | A1 | | 9/1996 | |
| DE | 202008004546 | U1 | | 7/2008 | |
| DE | 102010044185 | A1 | | 1/2012 | |
| EP | 0649944 | A1 | | 4/1995 | |
| EP | 2230357 | A2 | | 9/2010 | |
| EP | 2372025 | A1 | * | 10/2011 | |
| EP | 2372025 | A1 | | 10/2011 | |
| WO | WO99/08504 | A1 | | 2/1999 | |
| WO | 2005/118959 | A1 | | 12/2005 | |

OTHER PUBLICATIONS

English machine translation of DE3703865.*

International Search Report issued for PCT/US2019/062446, dated Jan. 21, 2020.

Written Opinion of the International Searching Authority issued for PCT/US2019/062446, dated Jan. 21, 2020.

Search Report issued in related European patent application serial No. 16172867.0, dated Oct. 10, 2016.

* cited by examiner

PAVEMENT JOINT CLEANING SYSTEM

CROSS-REFERENCE TO RELATED APPLICATION

The present application is a Continuation-in-part of U.S. patent application Ser. No. 15/170,539, filed on Jun. 1, 2016 which is based on and claims the benefit of U.S. provisional patent application Ser. No. 62/171,123, filed Jun. 4, 2015, the contents of which are hereby incorporated by reference in their entirety.

BACKGROUND

Various outdoor surfaces comprise networks of pavers positioned in selected areas and according to selected designs. Pavers are generally segmental pieces of concrete, clay, or like materials and having various shapes which allow a series of pavers to be laid and interconnected to form a substantially continuous surface for walking, driving or otherwise supporting various activities. When pavers are laid to form a surface, the pavers are spaced from each other. The spaces are referred to as joints and extend around the perimeter of each paver and exist substantially along the perimeters between any two adjacent pavers. The joints allow the shape of the paver to be discernible and provide a pattern to the paver surface. These joints are not normally grouted nor is adhesive typically used to lay and secure the pavers.

In a typical paver arrangement, sand is placed in the spacing between the pavers. The sand holds the pavers together in the pattern selected. In essence the individual pavers float but are secured in this sand matrix.

Such paver surfaces, however, are not amenable to water drainage. Water typically flows along the top surface of the pavers and joints, causing excessive runoff in many situations. To solve this problem, a drainage system has been developed. The pavers are initially positioned on a surface under which water may flow. Instead of sand being placed in the paver joints, crushed rocks are used. The crushed rock permits water to drain between the pavers, through the paver joints, and into the drainage system below.

Such drainage systems have worked well. However, over time, fine debris may accumulate in and on these joints and even form a crust. The crust becomes water impermeable, thereby negating the water permeability of the joint. Further, pressure washing drives silt deeper into the surface of the crushed rock, where it cannot be removed.

Prior art methods of cleaning these paver joints are labor intensive and time consuming. Such methods generally comprise pressure washing with water the joint area. Pressure washing although may remove the crust; it results in the production of sludge. The removal of the sludge/silt requires additional labor. In addition, the sludge may be considered a hazardous waste and as a result has to be disposed of in compliance with certain government regulations relating to hazardous waste. This compliant disposal/removal adds to the cost of the removal of the crust. Presently there is no effective way to efficiently clean paver joints over any large surface area.

SUMMARY

An aspect of the present disclosure relates to a pavement joint cleaning system having a cleaning device that is a wheeled housing having at least one pair of pavement surface engaging wheels and a rotatable shaft carrying a plurality of nozzles, wherein the nozzles are configured to receive a pressurized flow of air and to direct the flow of air toward the pavement surface to dislodge debris from the pavement surface. A motor is operably connected to the rotatable shaft and configured to transfer torque from the motor to the rotatable shaft. A handle extends from the wheeled housing and allows an operator to move the wheeled housing over the pavement surface manually.

The motor is operably connected to the rotatable shaft and a belt is configured to transfer torque from the motor to the rotatable shaft allowing the operator to selectively control the rate of rotation of the shaft as the cleaning device is moved across the pavement surface. A trigger is positioned on the housing and operably connected to the motor to allow the operator to selectively control the rate of rotation of the shaft via the trigger.

The pressurized air flow is provided as a jet of compressed air to and through the plurality of nozzles and the air flow from the nozzles is sufficient to dislodge the debris from the joints without incorporating a cleaning agent or liquid flow into the cleaning system. Thus, the system is a dry system, using pressurized air to dislodge debris from joints in the paver surface and negative pressure to remove the dislodged debris form the surface.

The system also has a debris removal device that is a wheeled housing with at least one pair of pavement surface engaging wheels and the housing supports a suction head having an inlet end and an outlet end and connectable with a vacuum source at the outlet end to remove dislodged debris from the pavement surface through the inlet end. The debris removal device also has a handle extending from the wheeled housing and configured to allow an operator to manually move the wheeled housing over the pavement surface.

In the present disclosure, the pavement surface is a surface having an array of pavers and joints there between.

In another aspect of the present disclosure, the wheeled housing of the cleaning device is a first wheeled housing and the wheeled housing of the debris removal device is a second wheeled housing separate from the first wheeled housing. The cleaning device and debris removal device are hand-operated and are walk-behind devices that can be manually moved over the pavement surface.

Another aspect of the present disclosure relates to a method of cleaning a surface area comprised of a plurality of pavers and having at least one paver joint. Cleaning the surface area includes providing a first moveable housing having a rotatable wand with a plurality of nozzles supported thereon and configured to direct an airflow from the nozzles and providing a flow of compressed air to the plurality of nozzles. The method also includes moving the housing over a selected area comprising the plurality of pavers at least one paver joint and rotating the plurality of nozzles and providing an outward airflow and adjusting the rotation of the wand by selectively adjusting the RPM of a motor that is connected to the wand by a belt and pulley system configured to transfer torque from the motor to the wand to dislodge debris from the surface area.

Cleaning the surface area also includes debris removal by providing a second movable housing having a suction head configured for passing over the surface area and removing the dislodged debris from the surface area and moving the second housing over the selected area and removing the dislodged debris.

DETAILED DESCRIPTION

The present disclosure relates to a portable cleaning system for outdoor surfaces. The system may effectively be used to clean a variety of surfaces, which may for example comprise pavers or paving stones of brick, stone, tile, ceramic or other segmental materials. Surfaces may also include concrete and/or paved surfaces that may have "pavement joints" for cleaning. The surfaces described previously, also referred to as exterior flooring may comprise patterns of pavers selectively laid on a ground surface to form pathways, drive ways, roads, patios, walkways and other outdoor platforms and the joints formed between the pavers when forming the pattern. The joints are generally small open spaces or lengths surrounding each paver and present between each two adjacent pavers. The joints may be filled with a sand component, and in the case of joints that permit water to drain through, crushed rock.

The cleaning system of the present disclosure removes debris that has accumulated on or in the joints. Such debris accumulates over time and may include organic or inorganic debris such as fine sand or pebbles, grit, dirt, bits of plant matter such as bits of foliage, bark, or wood. Over time, the debris may form a hard crust on the joint surface which becomes impermeable to water, thereby negating the drainage characteristic of the joint.

The cleaning system of the present disclosure removes the surface debris from the joints between pavers with or without the use of water or other wet cleaning solutions. The system may instead utilize only air (or other types of gas) flow under pressure to dislodge and clean debris from the paved surface and the corresponding paver/pavement joints. The system also includes a corresponding vacuum component configured to remove the dislodged debris from the area. For example, the cleaning system of the present disclosures combines a compressed air flow device and debris suction device that work in tandem to thoroughly clean the joints. The joints are "scrubbed" clean without the use of water or other fluids or liquid cleaning solutions. The debris is then removed from the surface via vacuum system. The system is portable and thus can be used to scrub joints otherwise inaccessible to large cleaning trucks and prior art equipment, such as but not limited to sidewalks, plazas, parks, and elevated areas.

Further, the compressed air is delivered to the joints or other target areas where hard crusts or caked on materials have accumulated through one or more nozzles on a rotating wand. The wand may be configured such that the nozzles rotate and the compressed air flow through the one or more nozzles cracks the hard crust and blows out the joint to scrub the joint, up to the full depth of the joint, with the compressed air leaving substantially all of the crushed rock in the joint. The system is configured to generate an air flow through the nozzles such that the air flow alone is sufficient to scrub the joint.

Figure 1:
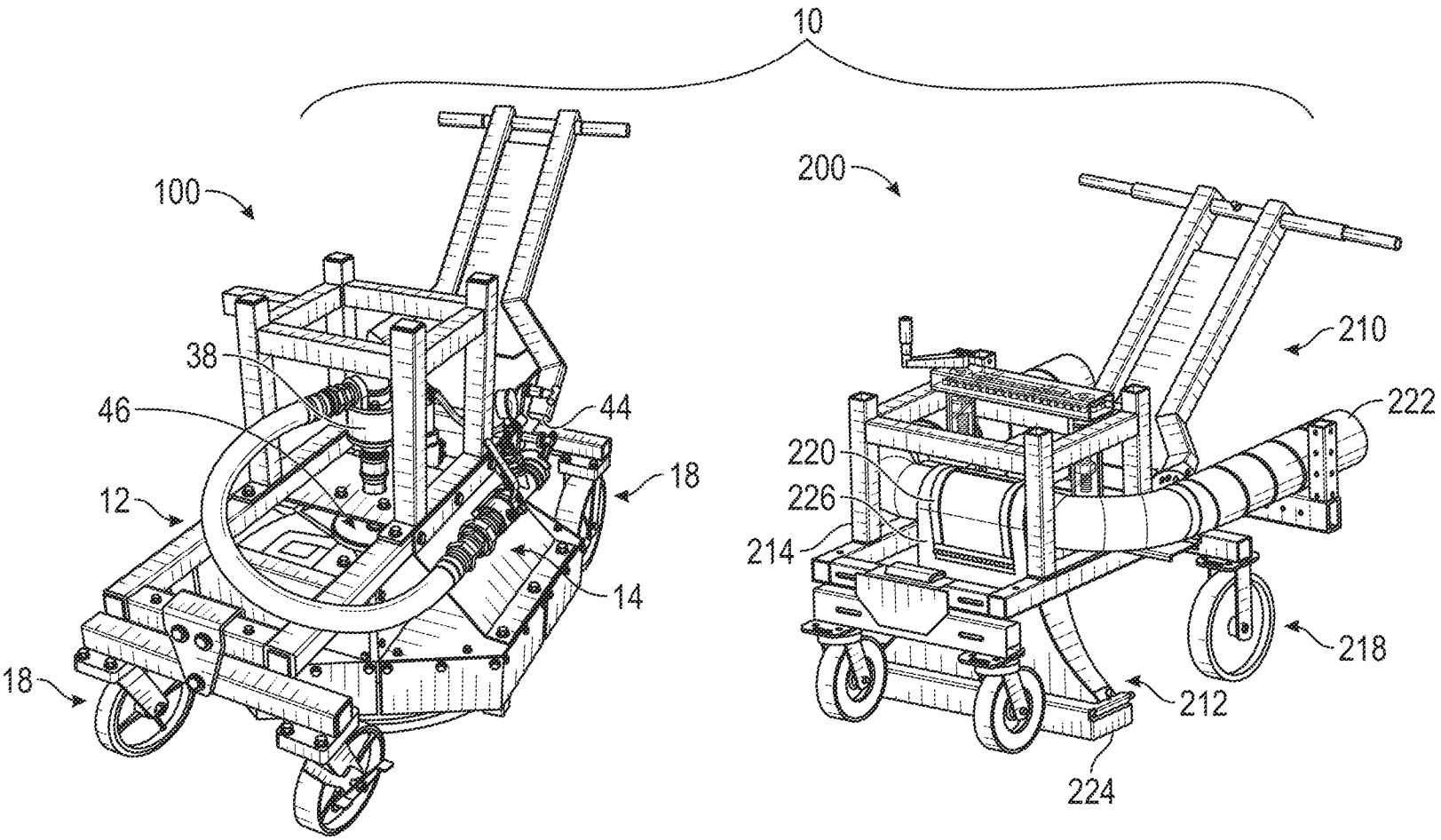
FIG. 1 is a perspective view of a paver joint cleaning system.
Figure 2:
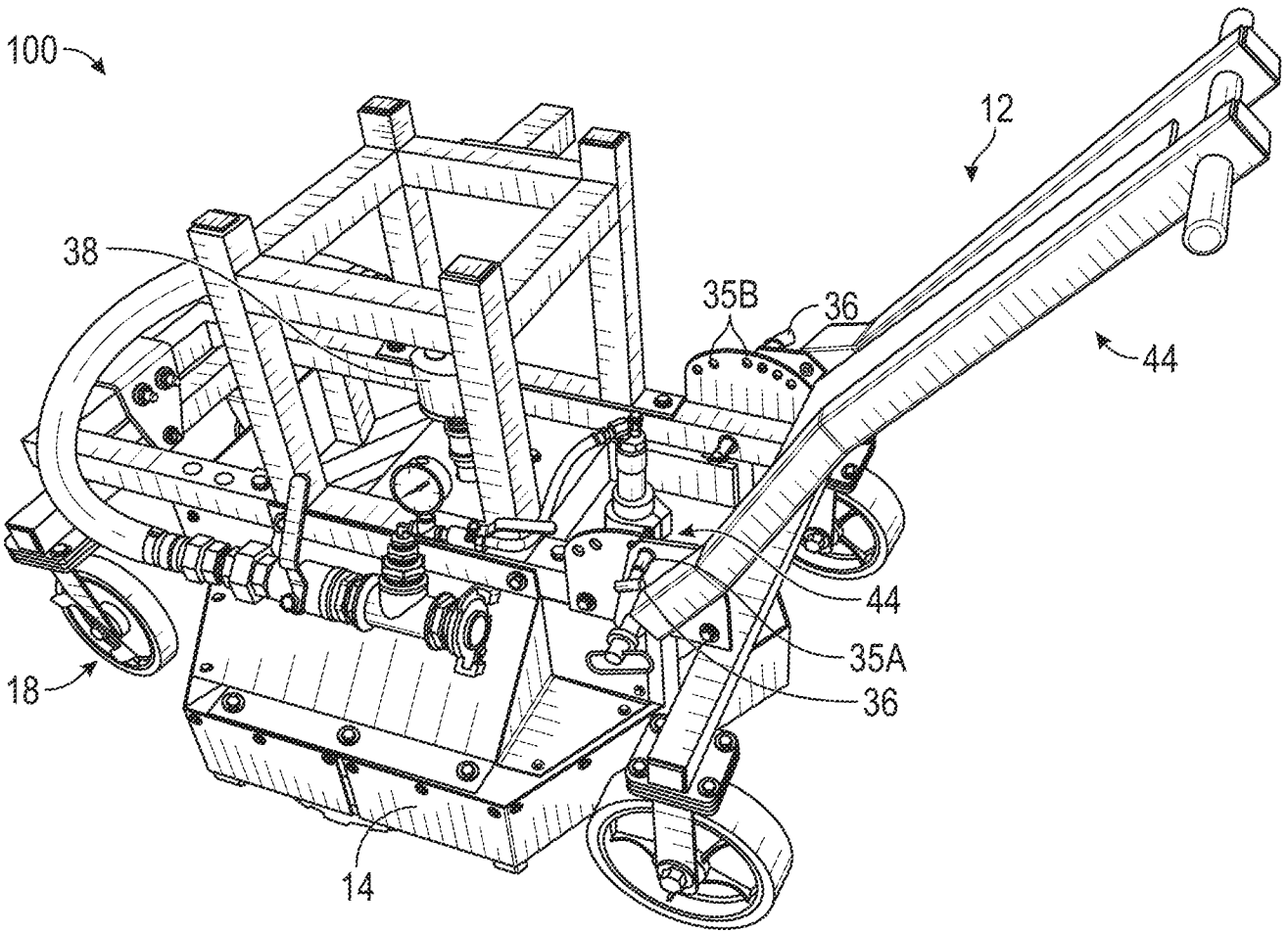
FIG. 2 is a perspective view a wheeled housing of the cleaning device.

The paver joint cleaning system is illustrated generally at 10 in FIG. 1 and comprises a hand-operated joint cleaning device 100 and a debris removal device 200. As illustrated in FIGS. 1-3, and 5A-5B, the joint cleaning device 100 comprises a wheeled housing 12 providing a covered cleaning area. The wheeled housing 12 comprises a cover 14 that is configured to contain dislodged debris for subsequent vacuum removal with the debris removal device 200. The housing 12 also supports operational components of the cleaning device 100. The wheeled housing 12 comprises casters and wheel pairs or opposing pairs of wheels 18. The wheels 18 allow the system to be easily portable and hand operable for movement over the cleaning surface. The housing 12 further includes an aperture 20 allowing for a sealed connection with a hose or tube 22. The aperture 20 may be fitted with a pipe coupling 21 which allows for connection of the tube 22 to the system and allows for providing only air, gas (or in an optional embodiment air/gas and water) into the housing 12 and to a nozzle system 24 for delivery of the compressed air to the cleaning surface.

Figure 3:
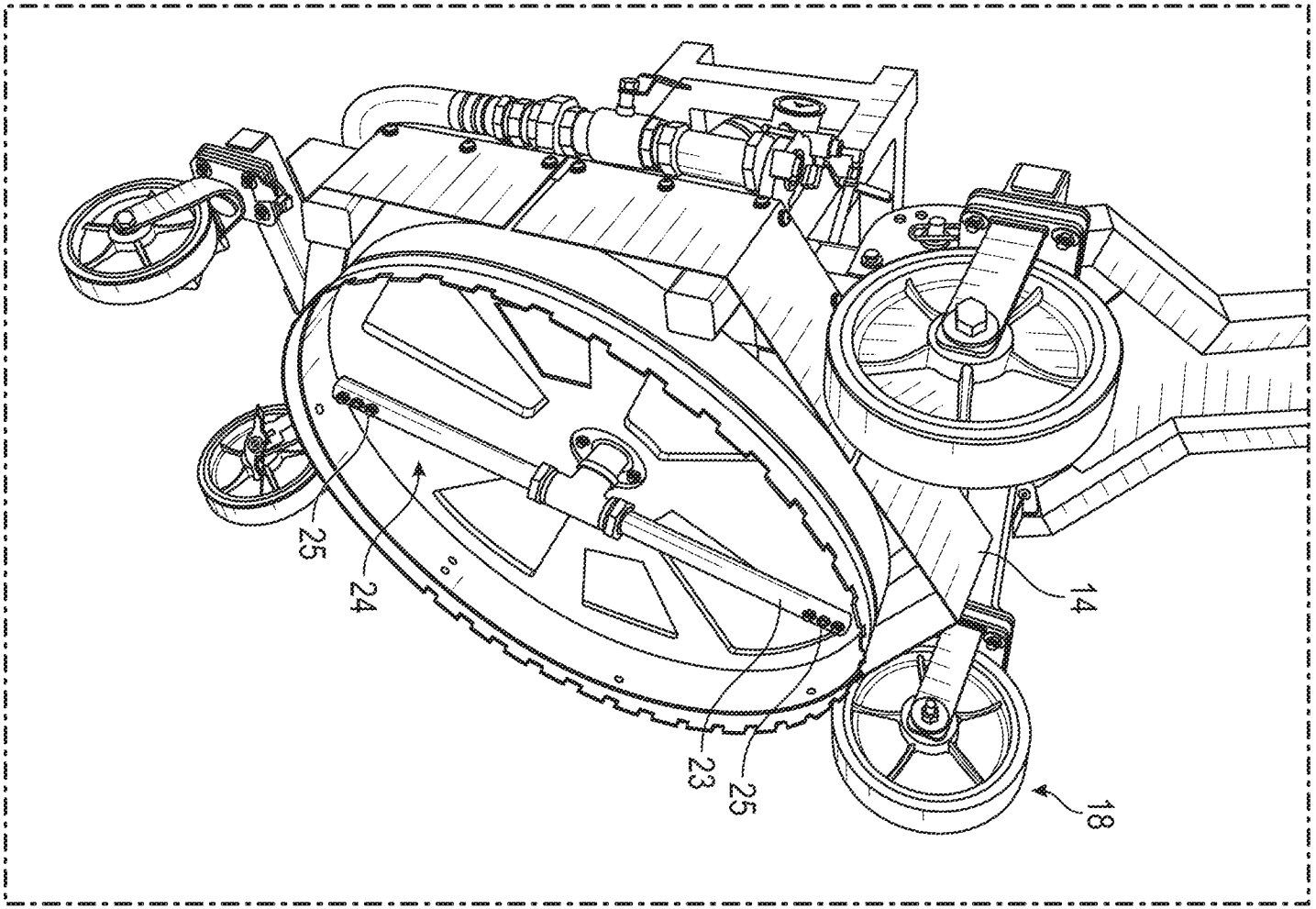
FIG. 3 is a bottom view of the wheeled housing of the cleaning device.

Referring to FIG. 3, the nozzle system 24 comprises a rotating wand 23 supporting the one or more nozzles 25 for delivering air or gas under pressure from the device 100 to the cleaning surface. The nozzles 25 are secured to ends or a length of the wand 23 so that as the wand 23 rotates, the nozzles 25 rotate. In the embodiment illustrated in the figures, the wand 23 operably supports four air delivery nozzles 25. A rotational speed of the wand 23 is adjustable and the speed may be increased or decreased depending on the surface to be cleaned and the amount of debris to be dislodged from the joint or surface.

The nozzle system 24 is secured below the cover of the housing for positioning above the joint(s) and/or other cleaning surface. The nozzle system 24 thus hovers slightly over the surface to be cleaned as the wheels extend from the housing 12 to engage with the ground surface. The nozzle system 24, having one nozzle or a plurality of individual nozzles that move in a cooperating manner, is operably connected to the tube 22 such that compressed air flow can be directed to and through the nozzle system 24. The nozzle system is preferably positioned to extend a sufficient distance toward the ground or pavement/paved surface but not so far as to be in contact with the pavement engaging surface. Thus, the nozzle system 24 is freely rotatable.

The wand 23 is a shaft that rotates in a generally horizontal plane with respect to the ground surface, and comprises downwardly oriented nozzles 25 positioned, for example, at the opposing terminal ends of the shaft. The nozzles 25 are configured to receive the air (or other gas) flow under pressure and to direct the air flow downwardly to the paver and/or paver joint surfaces. The nozzles 25 also then are configured to rotate horizontally with the wand 23 within the covered cleaning area to provide a cleaning area that is determined by the length of the shaft and thus the position of the nozzles 25. The rotational speed of the nozzle(s) allows the nozzles and forced air to clean the surface and joints. The frame 12 supports an actuator for controlling the rotational speed of the air nozzles during cleaning. The nozzles 25 direct forced air (or alternatively, forced air with a minimal amount of water) to the surface and joints and the controllable variable speed of rotation of the nozzles enhances and controls cleaning of the surface and the joints. The housing is of sufficient size to cover the cleaning area defined by the rotating nozzles 25. Further, the movement of the device 100 along the surface during operation extends the cleaning surface area. The area that can be cleaned may not be bounded or otherwise limited, as the device 100 is configured for movement in various directions over the surface.

The pressurized air source may be present on or in the housing 12, on a truck, or on a separate movable cart for providing the air or gas under pressure to the system 10 while being portable with the system 10. Thus, the system 10 can be used to clean surfaces of varying sizes. The pressurized air source may be an air compressor for delivering the compressed air flow to the nozzles 25. In the embodiment illustrated, the compressor is a high pressure air compressor with a pressure rating of at least about 250 CFM at about 205 PSI at the nozzles 25, and more preferably has a pressure rating of about 260 CFM at about 205 PSI at the nozzles. The high pressure air compressor delivers sufficient air energy at a sufficient pressure to the nozzles when directed to the joints.

The housing 16 further comprises an upwardly extending handle 44 which extends sufficiently upwardly at a slight incline which allows the handle 44 to be used not only for steering the housing 12 during movement and cleaning. The handle position (e.g., height or angle/incline) may be manually adjusted by way of a securable connection by a locking pin 36 between an aperture 35A on the lower side arms of the handle (and extending upwardly from the base 12) and a series of apertures 35B extending upwardly from the rear of the base for positioning the handle at one of a plurality of inclines. A valve 37 is operably connected to control a motor 38 which may also be positioned on the housing 16. The motor 38 is configured for controlling the rotation of the nozzles 25. The speed or revolutions per minute (RPM) of the motor can be selectively controlled via actuation of the valve 37. Examples of a motor 38 include but are not limited to a gas engine, electric motor, pneumatic motor, or air motor. Changing the RPM of the motor allows the operator to continue cleaning while adjusting the rotation speed of the nozzles 25, rather than adjusting the pace in which the operator moves the base 12.

The motive force of the motor 38 may be transmitted to the rotating air nozzles by way of a dual pulley and belt system. The dual pulley and belt system includes a first pulley 44 attached to a drive shaft of the motor 38. A second pulley 46 is attached to the rotational air nozzles. A continuous belt connects the first pulley 44 and the second pulley 46. The belt transfers rotational force from the first pulley 44 to the second pulley 46 thereby rotating the air nozzles. As addressed previously, the rotation speed of the nozzles is proportional to cleaning and can be controlled by the pulley system to enhance cleaning on tougher or dirtier surfaces/joints and vice versa.

The motor 38 may then be connected to the driveshaft. Torque is then transferrable from the motor 38 to the nozzle system 24 thus the motor 38 controls the rate of rotation of the wand 26 and thus nozzles 25. Air circulation in the system 100 is thus controlled directly by the motor 38. As the RPM of the motor 38 is adjusted, so is the rotation of the nozzle system 24. The pulleys may be of a substantially equal diameter. In one embodiment, the first pulley is configured to transfer RMPs for rotational speed to the second pulley such that the pulleys are configured with different pitch diameters. For example, the second pulley 46 may have a smaller pitch diameter than the first pulley 44. Thus, adjusting the RPM of the motor 38 by operation of valve 37 allows the operator to selectively control the rotational speed of the nozzles 25. The air circulation in the system 100 may then be adjusted according to the needs of the surface to be cleaned.

In the embodiment illustrated, six nozzles 25 are used to achieve sufficient pressure of the free air at the nozzle from the compressed air source. However, for example, at the tip of the nozzle about 205 PSI is provided with each of four nozzles. The number of nozzles may be adjusted by taking into consideration the nozzle diameter being sufficient enough to consume the energy from the compressed air source where the pressure at each nozzle is substantially identical and maintains sufficient air volume to clean a joint without breaking or cracking the paver surface.

Once the debris has been loosened and/or dislodged from the joint and/or surrounding surface areas, surface vacuuming can be completed to remove the debris from the area. A suction head configured to operably couple to a vacuum hose, such as a 6 inch vacuum hose is provided. The suction head is optimized to apply negative pressure to the pavement surface and to fully excavate the loosened material from the joint and surface. The suction head is adjustable to account for varying surface heights with respect to the joint, joint depth or surface area around the joints. The suction head is operably coupled to a vacuum source for debris removal.

The system 10 further comprises a debris collection device 200. The debris collection device 200 is illustrated in FIG. 1. The debris collection device 200 is a wheeled cart 210 supporting a suction head 212 and conduit for connection to a vacuum source (not shown) for providing negative pressure to the suction head and for removal and collection of debris dislodged from joints and other cleaning surfaces with the cleaning device 100 discussed above. The wheeled cart 210 also supports operational components of the collection device 200. The wheeled cart 210 comprises casters and wheel pairs or opposing pairs of wheels 218. The wheels 218 allow the system to be easily portable and hand operable for movement over the cleaning surface.

The wheeled cart 210 has a frame 214 and supports the suction head 212 thereon. The frame 214 also supports a vacuum hose coupling port 220 for connecting the suction head 212 with the vacuum source and a debris removal and/or collection mechanism. That is, the device 200 can be connected to at least one vacuum source (not shown) by fluidly connecting at least one vacuum hose 222 between the vacuum source and the suction head 212. The debris removed via vacuum can be delivered away from the joint to a collection mechanism. The vacuum source may be carried on a portable cart, worn by a user, carried on a truck or otherwise configured to be portable with the operator. The vacuum device 200 and suction head 212 are also configured for operable connection to any vacuum generated equipment ranging from sewer trucks to portable vacuum trailers.

Figure 4:
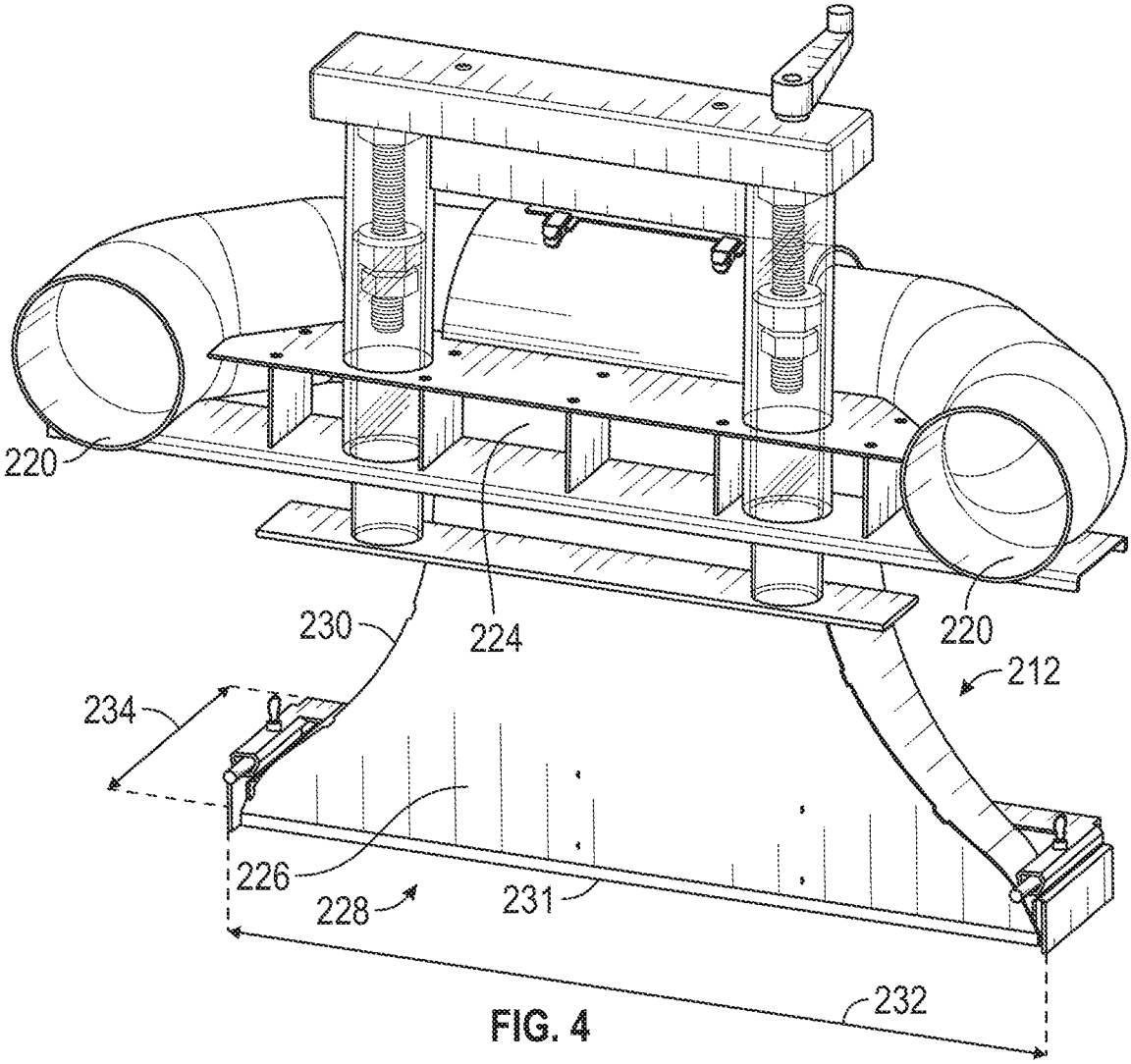
FIG. 4 is a rear perspective view a suction head of a debris removal device of the system separated from the debris removal device for ease of illustration.
Figure 5A:
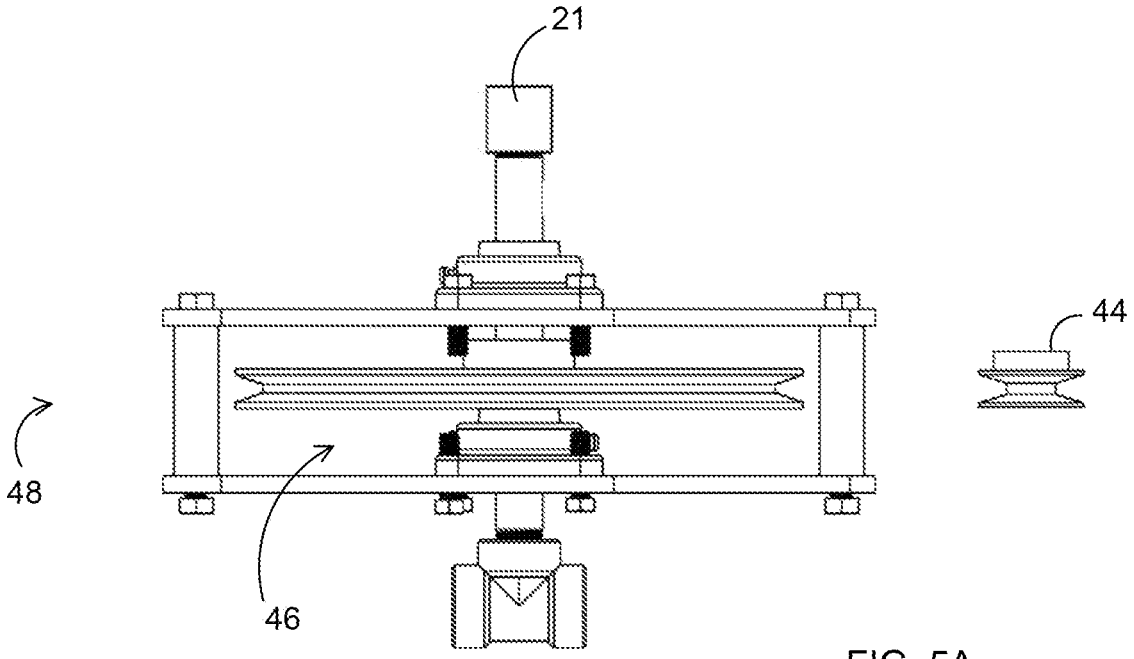
FIG. 5A is a side view of a dual pulley system of the cleaning system where the pulley is illustrated as isolated from the wheeled housing for clarity.
Figure 5B:
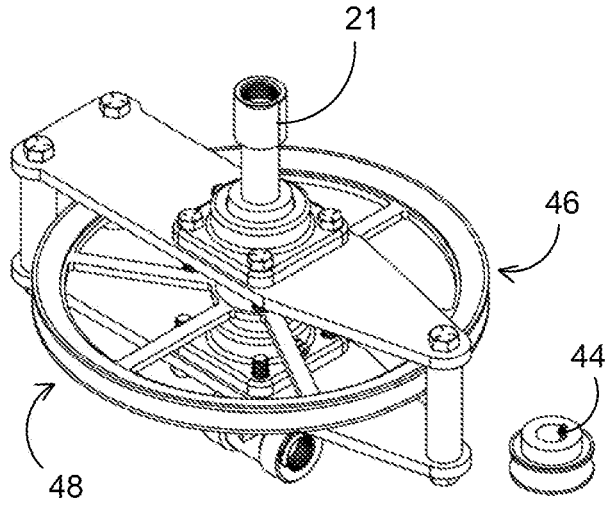
FIG. 5B is a side perspective view of the isolated dual pulley system of the cleaning system.

As illustrated in further detail in FIGS. 1 and 4, the suction head 212 extends substantially across a front width of the cart 210 to provide vacuum suction to a joint and/or cleaning surface. The suction head 212 comprises a first end 224 terminating in connection with the vacuum hose coupling port 220 and a second, opposing end 226 terminating in a ground engaging debris collection inlet 228. A housing 230 extends between the first end 224 and the second end 226 of the suction head 212. Surrounding the debris collection inlet 228 is a perimeter wall 231. The ground engaging perimeter wall 231 may be rectangular in shape, having a width 232 at least three times greater than its depth 234. The housing 230 is tapered from the second end 226 of the suction head 212 to the first end 224 of the suction head 212. That is, dimensions of the second end 226 are less than dimensions of the first end 224. The opening in the vacuum hose coupling port 222 which is also a debris collection outlet of the suction head 212 and allows for providing negative pressure to the suction head 212 and removal of debris from the cleaning surface, is smaller in size than the inlet collection inlet 228.

One or more outlets/vacuum ports may be positioned near the rear or back side of the wheeled cart 210. This allows the outlet to suck up and provide a path for removal of debris dislodged by the air flow or the flow of air and water as the system is pushed forward or backward over the paver surface. The operator may control the movement of the vacuum hoses to remove debris as the debris is dislodged from the joints and settled on the paver surface by moving the base 12 to pass over the cleaning area.

The suction head 212 may be further adapted with side walls comprising bristles or brush like components extending downwardly from or along the perimeter wall 230 of the suction head to engage with the ground surface or pavers. The brushes are configured to prevent the debris from blowing away and contain the debris under the housing so that the debris can be removed by moving the vacuum port(s) over the loose debris.

The wheeled cart 210 further comprises an upwardly extending handle 244 which extends sufficiently upwardly at a slight incline which allows the handle 224 to be used not only for steering the cart 210 during movement and vacuuming, but also to support an actuator for controlling the vacuum suction.

It is also contemplated that the cleaning device 100 of the system 10 may also incorporate hydro force, that is, the system may also be configured for connection to a local water supply, for example a garden hose, exterior tap or faucet, city water, or even a portable water supply/source where a small amount of water can be incorporated into the compressed air flow to form a hydro force jet for cleaning. The water and compressed air mixture may be ejected from the nozzles 25 as described above with the hydro force control being connected to the air supply or may additionally or alternatively be incorporated into a selectively usable wand terminating in a nozzle. Thus, the user has the option to use only compressed air or to use the combination of water and compressed air. The water incorporated in the compressed air flow may act as a solvent and/or cleaning medium for the surfaces to be cleaned. The amount of water used is sufficiently small enough to significantly reduce the recovery burden of the water. The water remaining on the surface after cleaning is small enough to be effectively removed by the vacuum suction or to evaporate since not enough water was used to develop pooling or puddling during standard cleaning.

When the water and compressed air mixture is incorporated, the compressed air source may be connected via tubing to the handle which is further connected to a barrel 60 which has two inlets 62 and 64, one for connection to first hose for the compressed air source and a second inlet configured to connection to a water source, generally also via connection to a hose. The delivery of the compressed air through the handle and barrel 60 to an outlet hose or tube which terminates in connection to the wand and the nozzles 28 is controlled by a trigger 66 or switch operable from the handle. A valve (not shown) is positioned in the barrel 60 to control the water flow through the handle to the outlet hose or tube and to an exit orifice, or nozzle 28. When the trigger 66 is pulled, compressed air flows through the handle and pushes the valve to open, which allows a flow of water to enter the barrel 60. As the water and compressed air are directed to the barrel, the water and air mix in the barrel and travel through the hose or tube to the nozzle as a jet. Thus, the compressed air is turbulently mixed with a small amount of water to provide a hydro force jet for cleaning.

Although the present disclosure has been described with reference to preferred embodiments, workers skilled in the art will recognize that changes may be made in form and detail without departing from the spirit and scope of the disclosure.

The invention claimed is:

1. A paver joint cleaning system comprising:
- a cleaning device comprising:
  - a wheeled housing comprising:
    - at least one pair of paver surface engaging wheels;
    - a rotatable shaft carrying a plurality of nozzles, the nozzles configured to receive a pressurized flow of air and to direct the flow of air toward the paver surface and into a depth of the paver joint wherein the pressurized flow dislodges debris from within a depth of the paver joints and paver surface;
    - a motor operably connected to the rotatable shaft and configured to transfer torque from the motor to the rotatable shaft and wherein the rotation of the rotatable shaft is adjustable during use by adjusting an RPM of the motor; and
    - a handle extending from the wheeled housing and configured to allow an operator to move the wheeled housing over the paver surface; and
- a debris removal device comprising:
  - a wheeled housing comprising:
    - at least one pair of paver surface engaging wheels;
    - a suction head having an inlet end and an outlet end and connectable with a vacuum source at the outlet end to remove the dislodged debris from the paver joints through the inlet end; and
    - a handle extending from the wheeled housing and configured allow an operator to move the wheeled housing over the pavement surface.

2. The system of claim 1, wherein the suction head has a first width at the inlet end and a second width at the outlet end and wherein the first width is greater than the second width.

3. The system of claim 1, wherein the inlet end is rectangular in shape.

4. The system of claim 1, wherein the motor is operably connected to the rotatable shaft and a belt configured to transfer torque from the motor to the rotatable shaft allowing an operator to selectively control the rate of rotation of the shaft.

5. The system of claim 4, and further comprising a trigger positioned on the housing and operably connected to the motor to allow the operator to selectively control the rate of rotation of the shaft.

6. The system of claim 1, wherein the motor is a gas engine, electric motor, pneumatic motor, or air motor.

7. The system of claim 1, wherein the wheeled housing of the cleaning device is a first wheeled housing and the wheeled housing of the debris removal device is a second wheeled housing separate from the first wheeled housing.

8. The system of claim 1, wherein the cleaning device is hand-operated and the wheeled housing thereof is moveable over the paver surface manually.

9. The system of claim 1, wherein the debris removal device is hand-operated and the wheeled housing thereof is moveable over the paver surface manually.

10. The system of claim 1, wherein the pressurized air flow is provided as a jet of compressed air to and through the plurality of nozzles and wherein the pressurized air flow is provided as a jet from the nozzles to dislodge the debris from the paver joints without incorporating a cleaning agent or liquid flow into the pressurized air flow.

11. A method of cleaning a surface area comprised of a plurality of pavers and having at least one paver joint, the method comprising:

providing a first moveable housing having a rotatable wand with a plurality of nozzles supported thereon and the nozzles having outlets oriented downwardly from the connection with the rotatable wand and the plurality nozzles configured to direct an airflow outwardly from the plurality of nozzles into a depth of at least one paver joint, wherein a paver joint is a joint between adjacent paver segments;

providing a flow of compressed air to the plurality of nozzles;

moving the housing over a selected area comprising the plurality of adjacent pavers and at least one paver joint between adjacent pavers and rotating the plurality of nozzles while directing the airflow from the plurality of nozzles to the selected area;

scrubbing the at least one paver joint and dislodging material from within a depth of the at least one joint with the airflow from the plurality of nozzles as the airflow dislodges debris from the paver joint;

adjusting the rotation of the wand by selectively adjusting the RPM of a motor that is connected to the wand by a belt and pulley system configured to transfer torque from the motor to the wand to dislodge debris from the surface area; and providing a second movable housing having a suction head configured for passing over the surface area and removing the dislodged debris from the surface area and moving the second housing over the selected area and removing the dislodged debris.

* * * * *